US005616992A

United States Patent [19]

Bildgen

[11] Patent Number: 5,616,992

[45] Date of Patent: Apr. 1, 1997

[54] ELECTRONIC STARTER CIRCUIT FOR FLUORESCENT LAMP

[75] Inventor: Marco Bildgen, Provence, France

[73] Assignee: SGS-Thomson Microelectronics S.A., Saint Genis Pouilly, France

[21] Appl. No.: 551,226

[22] Filed: Oct. 30, 1995

[30] Foreign Application Priority Data

Oct. 28, 1994 [FR] France ..... 94 13009

[51] Int. Cl.[6] ..... H05B 37/02

[52] U.S. Cl. ..... 315/209 T; 315/209 CD; 315/101; 315/105; 315/200 R; 315/307

[58] Field of Search ..... 315/209 T, 209 CD, 315/101, 103, 105, 200 R, 207, 307, 360, DIG. 5

[56] References Cited

U.S. PATENT DOCUMENTS

| | | | |
|---|---|---|---|
| 3,875,459 | 4/1975 | Remery et al. | 315/103 X |
| 4,673,844 | 6/1987 | Maytum et al. | 315/200 R |
| 5,003,230 | 5/1991 | Wong et al. | 315/279 |
| 5,134,322 | 7/1992 | Bourgeois et al. | 307/571 |
| 5,455,486 | 10/1995 | Tobler | 315/102 |

FOREIGN PATENT DOCUMENTS

| | | |
|---|---|---|
| 0078790 | 5/1983 | European Pat. Off. . |
| 0520735 | 12/1992 | European Pat. Off. . |
| 4216716 | 10/1993 | Germany . |

*Primary Examiner*—Robert Pascal
*Assistant Examiner*—Haissa Philogene
*Attorney, Agent, or Firm*—Robert Groover

[57] ABSTRACT

An electronic starter for a fluorescent lamp comprises a power switch, controlled at its gate by a gate-control circuit and an auxiliary supply circuit that gives the necessary logic supply voltage to the gate-control circuit on a terminal of a capacitor. The gate-control circuit comprises a comparator with two voltage references to measure a duration of preheating of the lamp, the input of this comparator receiving the logic voltage given by the capacitor, the output of the comparator being used to command the closing or the opening of the switch. In one improvement, there is provided a preheating current measurement circuit to detect the optimum current for lighting up the lamp once the necessary preheating time has elapsed.

49 Claims, 3 Drawing Sheets

VG
5
COM
V-CONTROL
s'2
CURRENT MEASUREMENT
11
12
s2
23
22
21
COUNTER
16
inh
LOGIC CIRCUIT
9
17
18
19
20
8
Vdd s'2
11
15
ref
14
ip

ELECTRONIC STARTER CIRCUIT FOR FLUORESCENT LAMP

CROSS-REFERENCE TO RELATED APPLICATION

This application claims priority from French App'n 94-13009, filed 10/28/94, which is hereby incorporated by reference.

BACKGROUND AND SUMMARY OF THE INVENTION

The present invention relates to an electronic starter circuit for a fluorescent lamp.

Fluorescent light control differs from many electronics applications in that very high reliability is necessary, and low cost is also a very important objective.

The electrical behavior of the fluorescent lamps that contain pressurized gases (such as neon or argon) is similar to that of an avalanche zener diode with a resistance in the gas that becomes very low and negative after the breakdown.

A starter is needed to obtain the breakdown of the gas in the lamp: what has to be done is to prompt a surge voltage at the terminals of the lamp to ionize the gas. Thus it is usual to use an inductor and a device to short circuit the lamp and make the current flow. When the device is opened, the energy stored in the inductor gets converted into a surge voltage that causes the breakdown of the gas.

It is also preferable to preheat the filaments of the lamp in order to carry them to a temperature at which they easily emit electrons.

In practice, the duration of the short circuit is standardized depending on the category of lamp considered. For example, it is about 1.5 seconds for low-pressure fluorescent lamps. Standardization means that a lamp made by a given manufacturer can be used with a starter made by another manufacturer.

One type of commonly used starter is a two-strip starter (with a parallel-connected anti-parasitic capacitor). This low-cost electromechanical device enables a short circuit to be held for the fairly lengthy preheating time needed. (1.5 seconds), and then the opening of the short circuit to break down the gas.

However, the lamp does not always come on. So long as it is not lit (namely so long as the breakdown has not taken place), the two-strip device will continue to cycle. There is then a permanent flicker of the lamp that is particularly bothersome. Furthermore, the two-strip device may be damaged. Finally, the two-strip device opens for any current whatsoever. It may therefore open when the current is almost zero: the energy is then far too small to be efficient. It may also open at a time when the current is excessively high: then the lamp itself may be damaged.

To overcome these drawbacks, it has been sought to use electronic circuits, using in general a triac or a thyristor as a power device and a counter to limit the number of attempts made in order to light up the lamp.

These proposed circuits consume a great deal of current. They require very high capacitance for the capacitor used to hold the logic voltage needed to control the electronic power device (triac) and for the counting throughout the duration of the short circuit.

Furthermore, these circuits must measure the duration of the short circuit in order to then activate the opening of the electronic power device. Now this preheating time is relatively lengthy. It has been seen, in one example, that it had a standardized value of 1.5 seconds (for a low-pressure fluorescent lamp). It is not desirable to use a slow RC circuit to measure a period of such length. In particular, this is because it becomes necessary, in this case, to use a high resistance (of 1 megohm, for example) that reduces immunity to noise (with high input impedance).

It is preferred to use a fairly fast RC circuit followed by a high-capacity counter to measure the desired duration.

However, these electronic circuits consume a great deal of current and, in practice, they require an electrochemical type of high-capacitance capacitor to maintain the logic voltage, i.e. a capacitor with a capacitance of 100 or 1000 microfarads for example. This furthermore makes the circuits more fragile owing to the limited lifetime of these capacitors.

The present application discloses inventions which are intended to overcome these different drawbacks. The inventions relate to an electronic starter of a fluorescent lamp comprising a power switch parallel-connected with the lamp and supplied at high voltage, a gate-control circuit of said switch comprising a circuit for the measurement of a determined preheating time, and a auxiliary supply circuit parallel-connected with said switch and comprising a capacitor to give a logic supply voltage to the gate-control circuit on a terminal of said capacitor.

According to the invention, the preheating time measurement circuit comprises a comparator with two voltage references, a first voltage reference greater than a second voltage reference, the comparator having one input connected to the terminal of the capacitor and one output connected to a logic circuit to switch the first voltage reference over to the comparator when the high voltage is turned on, and so that:

upon the detection of an input voltage corresponding to the first voltage reference, it will deliver a start-of-preheating detection signal to activate the closing of the power switch and switch the second voltage reference over to the comparator, upon the detection of an input voltage corresponding to the second voltage reference, it will deliver an end-of-preheating detection signal to activate the opening of the power switch.

Advantageously, the gate-control circuit furthermore comprises a preheating current measurement circuit to deliver a signal to activate the opening of the switch after reception of the end-of-preheating detection signal, upon the detection of an optimum preheating current in the lamp.

According to another characteristic of the invention, to reduce the consumption current during the measurement of the preheating time, the gate-control circuit comprises a gate circuit that is placed between the logic supply voltage and the current measurement circuit and controlled by the logic circuit to turn the current measurement circuit off upon detection of the first voltage reference and turn it on upon detection of the second voltage reference.

BRIEF DESCRIPTION OF THE DRAWING

Other features and advantages of the invention shall appear from the following description, given by way of an indication that in no way restricts the scope of the invention and made with reference to the appended drawings, of which.

DETAILED DESCRIPTION OF THE PREFERRED EMBODIMENTS

Figure 1:
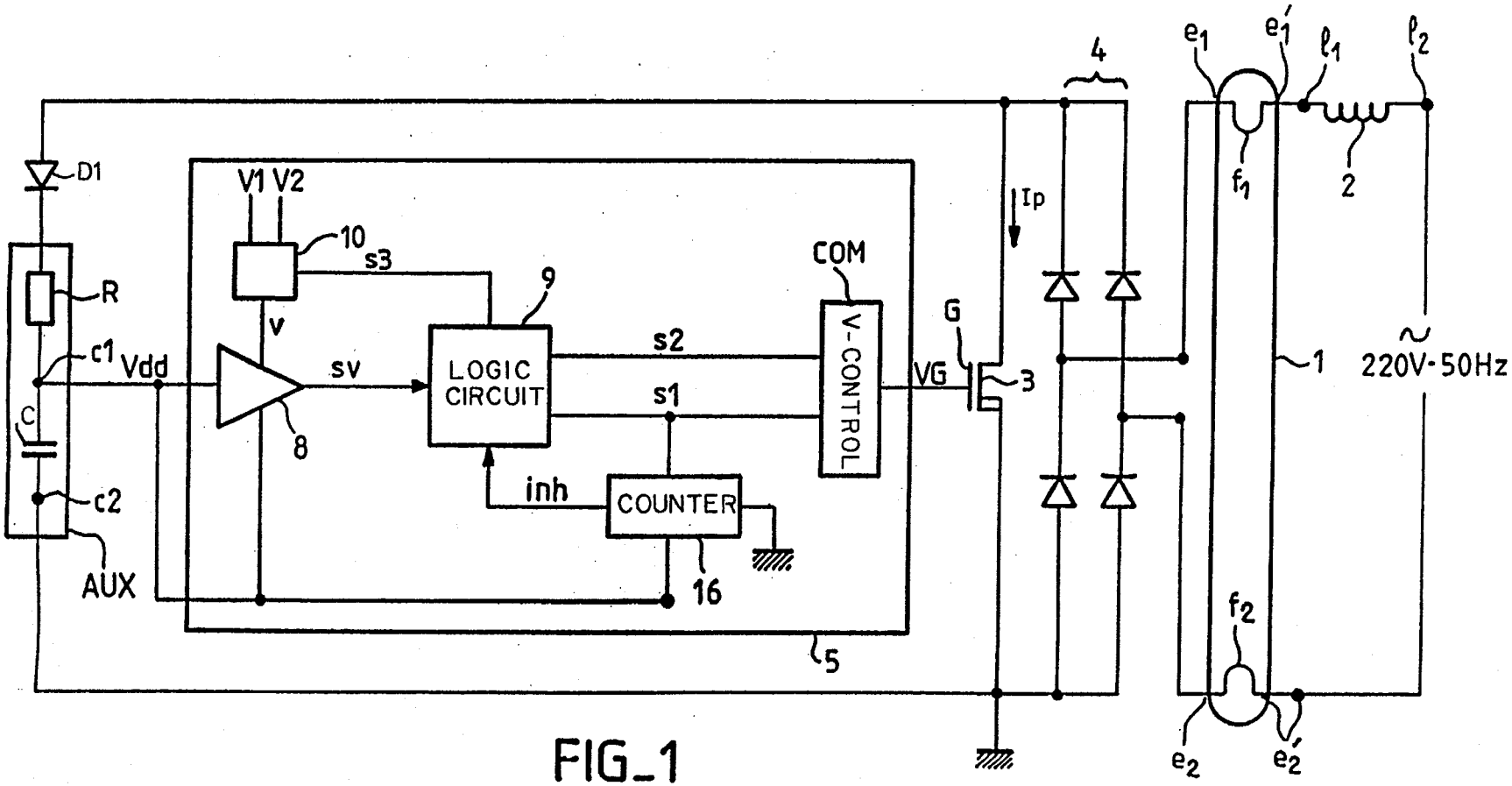
FIG. 1 shows a first variant of a diagram of an electronic starter applied to a fluorescent lamp according to the invention.

FIG. 1 shows a first variant of an electronic starter for a fluorescent lamp 1 according to the invention. The starter is connected between a terminal $e_1$ of a first filament $f_1$ of the lamp and a terminal $e_2$ of a second filament $f_2$ of the lamp. An inductor 2 has a first end l1 connected to the other terminal $e'_1$ of the first filament $f_1$. The unit formed by the lamp and the inductor is supplied at AC high voltage (in the example 220 volts—50 Hertz), applied between the other end $l_2$ of the inductor and the other terminal $e'_2$ of the second filament $f_2$ of the lamp.

The electronic starter has a power device 3 with gate-control G, a gate-control circuit 5 and an auxiliary supply circuit AUX.

The power device 3 with gate-control is connected between the terminals $e_1$, $e_2$ of the lamp through a diode-operated rectifier stage (diode ring) 4.

The gate-control power device 3 may, for example, be a field-effect MOS transistor as shown in FIG. 1 (N type MOSFET transistor) or an insulated-gate bipolar transistor or a control gate thyristor etc. Hereinafter, it is designated by the general term "power switch". It is closed, similarly to a short circuit if it lets through current, or opened to enable the breakdown of the gas in the lamp.

The gate G of the power switch is voltage-controlled by the gate-control circuit 5 to turn it on (which is equivalent to a short circuit) for a determined period of preheating of the lamp and then opened to enable the gas breakdown to happen in the lamp.

An auxiliary supply circuit AUX is parallel-connected to the power switch, to provide the logic voltage Vdd required by the gate-control circuit 5 and hold this voltage while the power switch is closed (which is equivalent to a short circuit). It comprises a capacitor C. On one terminal of this capacitor C, it gives the logic supply voltage Vdd required by the control circuit. More specifically, the auxiliary supply circuit comprises a resistor R connected between the high voltage and the terminal c1 of the capacitor which gives the voltage Vdd, the other terminal c2 of the capacitor being connected to the system ground. A diode D1, having the anode connected to the high voltage and the cathode connected to the resistor, can be used to prevent the discharging of the capacitor C by the power switch when the latter is closed (on). The peak value of supply Vdd would be limited by e.g. an avalanche breakdown (zener) diode (or a stack of series-connected diodes) in parallel with the capacitor C.

According to the invention, the gate-control circuit 5 comprises a circuit for measuring a determined preheating time during which the power switch 3 must be closed (on), this being equivalent to a short circuit.

The preheating time measurement circuit comprises a comparator 8 with two voltage references V1, V2, and a logic circuit 9. This comparator 8 receives, at its input, the logic supply voltage Vdd given by the auxiliary supply circuit at the terminal c1 of the capacitor. The comparator compares this input voltage Vdd to a voltage v, which is one of the voltage references V1 or V2 applied by a switch 10 which controlled by the logic circuit 9. The voltage V2 is lower than the voltage V1. Both of them take their value between the maximum logic voltage given by the auxiliary supply circuit and a minimum voltage for which the electronics of the control circuit may still function, for example between 15 and 3.5 volts.

The logic circuit 9 delivers a start-of-preheating detection signal s1 upon the detection, by the comparator, of an input voltage Vdd greater than or equal to the first voltage reference V1. It gives an end-of-preheating detection signal s2 upon the detection, by the comparator, of a logic voltage Vdd that has become lower than or equal to the second voltage reference V2. Finally it controls (using line s3) the switching of the voltage referenced V1 or V2 over to a voltage reference node v of the comparator 8.

The signals s1 and s2 are applied to a voltage-control circuit (COM) of the gate G of the power switch. Depending on the signals s1 and s2, it applies an appropriate voltage VG to the gate G to close the switch upon the detection of the start of preheating (s1) or to open it upon the detection of the end of preheating (s2). The signal s3 is applied to a switch 10 to switch the voltage V1 or the voltage V2 over to a reference node of the comparator 8.

Figure 2:
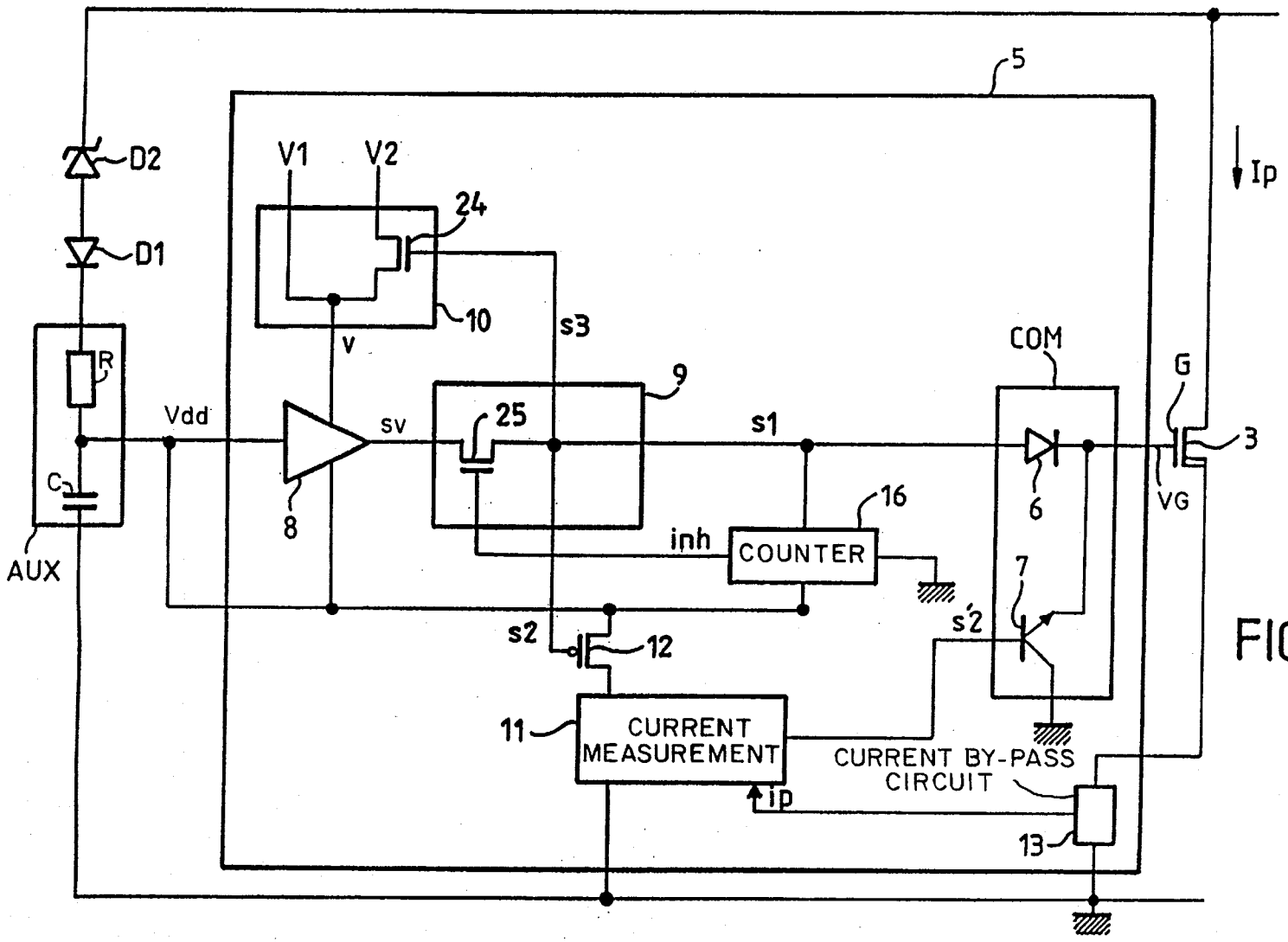
FIG. 2 shows a second variant of a diagram of an electronic starter according to the invention.

In the example shown, where the power switch is an N type MOSFET transistor, there must be a positive logic voltage at the gate G to close the switch (transistor on) and a zero logic voltage to open the switch (transistor off). In this example, the voltage control circuit then advantageously includes a diode 6 (as shown in FIG. 2) to switch the positive logic voltage to the gate G. The start-of-preheating detection signal s1 is then applied to the anode of the diode 6, the cathode of the diode being connected to the gate G of the power switch. The control circuit also includes a transistor 7 to set the gate at the ground. The end-of-preheating detection signal s2 is applied to the gate of the transistor 7, one electrode of which is connected to the gate G of the power switch, the other one being connected to the ground. In the example, the transistor 7 is an NPN type bipolar transistor that is on for a positive gate voltage and off for a zero gate voltage.

In one improvement shown in FIG. 2, a circuit 11 for the measurement of the preheating current of the lamp is advantageously designed for the control (using signal s'2) of the opening of the power switch for an optimal current value, after the detection of the end of the preheating.

The measurement of the current makes it possible to determine the appropriate time for opening the short circuit, once the necessary period of heating has elapsed. The aim is to open the switch when the current through inductor 2 will produce an optimal surge for lighting the lamp, i.e. neither too small to start current through the lamp nor so large as to damage the lamp.

Preferably, a gate circuit 12 is placed between the logic supply voltage Vdd and the current measuring circuit 11. It is controlled by the end-of-preheating detection signal s2, to turn off the current measurement circuit 11 during the preheating period, and to turn it on at the end of the preheating period, in order to control the opening of the switch for an optimum value of the preheating current flowing in the power switch (signal s'2).

A current bypass circuit 13 is then planned between the power switch 3 and the ground to shunt a small current ip to the current measurement circuit 11.

Figure 4:
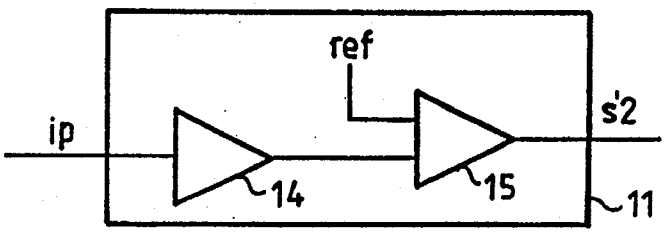
FIG. 4 is a diagram of a current measurement circuit used in the invention.

The current measurement circuit 11 comprises, as shown in FIG. 4, a current amplifier 14 followed by a comparator 15 with a current reference or power reference (ref) corresponding to an optimum preheating current Ip to light up the lamp. However, a problem of measurement of the preheating current arises, for the voltage is turned on for any value whatsoever of the preheating current. If the current measurement circuit is turned on again at a time when the current is rising and greater than the reference, then the comparator 15 will switch over for an excessively high preheating current. To overcome this drawback, the comparator 15 is preferably a window type comparator such that it switches over only when the current passes through the reference value ref with a negative slope. It could also be a comparator with a first comparison at zero: thus, it is certain that there will be no switching over for an excessively high value of current.

The gate-control circuit 5 preferably includes a counter 16 which counts the number of attempts made to light up the lamp (FIGS. 1 and 2). An incrementation (i.e. stepped increase) or decrementation (stepped decrease) command is given to counter 16 by the logic circuit 9. In the example, it is the preheating start detection signal s1 that is used but it is also possible to use the preheating end detection signal s2.

This counter delivers an inhibition signal inh to stop the starter if the lamp has not yet been lit up at the end of a number n of attempts permitted. This signal inh is applied in the example to the logic circuit 9.

The principle of operation of the starter according to the invention shall now be explained with reference to FIG. 2.

When the high voltage is turned on, the logic circuit 9 activates the switch 10 to apply the first voltage reference V1 to the comparator, for example at 15 volts. The output sv of the comparator is at zero.

The detection by the comparator of a logic voltage Vdd that becomes greater than or equal to V1 gives the starting point of the lamp preheating phase: the output sv of the comparator goes to 1.

The logic circuit 9 then generates the preheating start detection signal s1 to activate the closure of the power switch and switches the second voltage reference V2 over to the comparator. The counter 16 is incremented (or decremented by one unit).

Since the signal s1 is applied to the anode of the diode 6, this diode then switches the corresponding level logic level (now at 15 volts) to the gate G of the power switch 3. A preheating current Ip then flows in the power switch 3. The voltage at the terminals of the power switch drops and becomes practically zero.

The logic voltage Vdd is held by the auxiliary supply circuit but the capacitor C gets gradually discharged, through the consumption current of the gate-control circuit 5. The comparator 8 will then detect the passage to the lower voltage V2.

Since the consumption current of the gate-control circuit is perfectly known, the time at the end of which the voltage Vdd will drop from the voltage V1 to the voltage V2 is perfectly known. It depends on the capacitance of the capacitor, the consumption current and the voltage excursion (V2-V1).

Thus, according to the invention, the gate-control circuit 5 uses its own consumption to make a precise measurement of the preheating time. And the capacitor C of the auxiliary supply circuit is used both to hold the logic voltage and measure the necessary preheating time.

When the voltage comparator 8 detects a logic voltage Vdd corresponding to the second voltage reference V2, the logic circuit 9 activates the preheating end detection signal s2 to turn on the preheating current measurement circuit 11 again. This circuit 11 may then activate (s'2) the locking of the power switch until the occurrence of optimum value of the current IP for the preheating of the lamp.

The logic circuit can again switch over the first reference voltage V1 for a new preheating phase.

Since it is sought preferably to have a small capacitor, it is sought to have as low a current consumption as possible. In the invention, there is provision for cutting off the logic supply of the circuits not used during the measurement of the preheating time.

In the example shown in FIG. 2, the supply of the current measurement circuit 11 is thus cut off. This circuit consumes a great deal of power (because of the amplifier) and has no utility once the preheating period has elapsed. The supply is cut off by the gate circuit 12 activated by the end-of-preheating detection signal s2 delivered by the logic circuit 9.

By contrast, the counter 16 remains supplied so as not to lose its information.

In practice, it will therefore be enough, during manufacture, to make a precise measurement of the current consumed in the gate-control circuit as used during the measurement period to determine the value of the capacitance of the capacitor C and a value of the voltage references V1 and V2 to be capable of measuring the preheating period. In the case of the use of the current measuring circuit, it is also necessary to take account of the consumption of this current which turned on after the detection of the end of the preheating, it being known that the detection of the optimum current requires at most one or two current half-waves.

The use of the diode 6 to switch the positive voltage over to the gate of the power switch to turn it on is particularly advantageous, for this gate voltage is then held whatever may be the subsequent level of the logic supply voltage Vdd. It is thus possible to use a great voltage excursion of the logic supply voltage. The only limit is that laid down by the standard logic of the control circuit (and not by the minimum gate voltage needed to keep the switch closed).

The starter according to the invention thus makes it possible to obtain a small consumption current in the range of 1 microampere and a great voltage excursion (10 volts for example) permitting the use of a small capacitor with a capacitance of about one microfarad.

Figure 3:
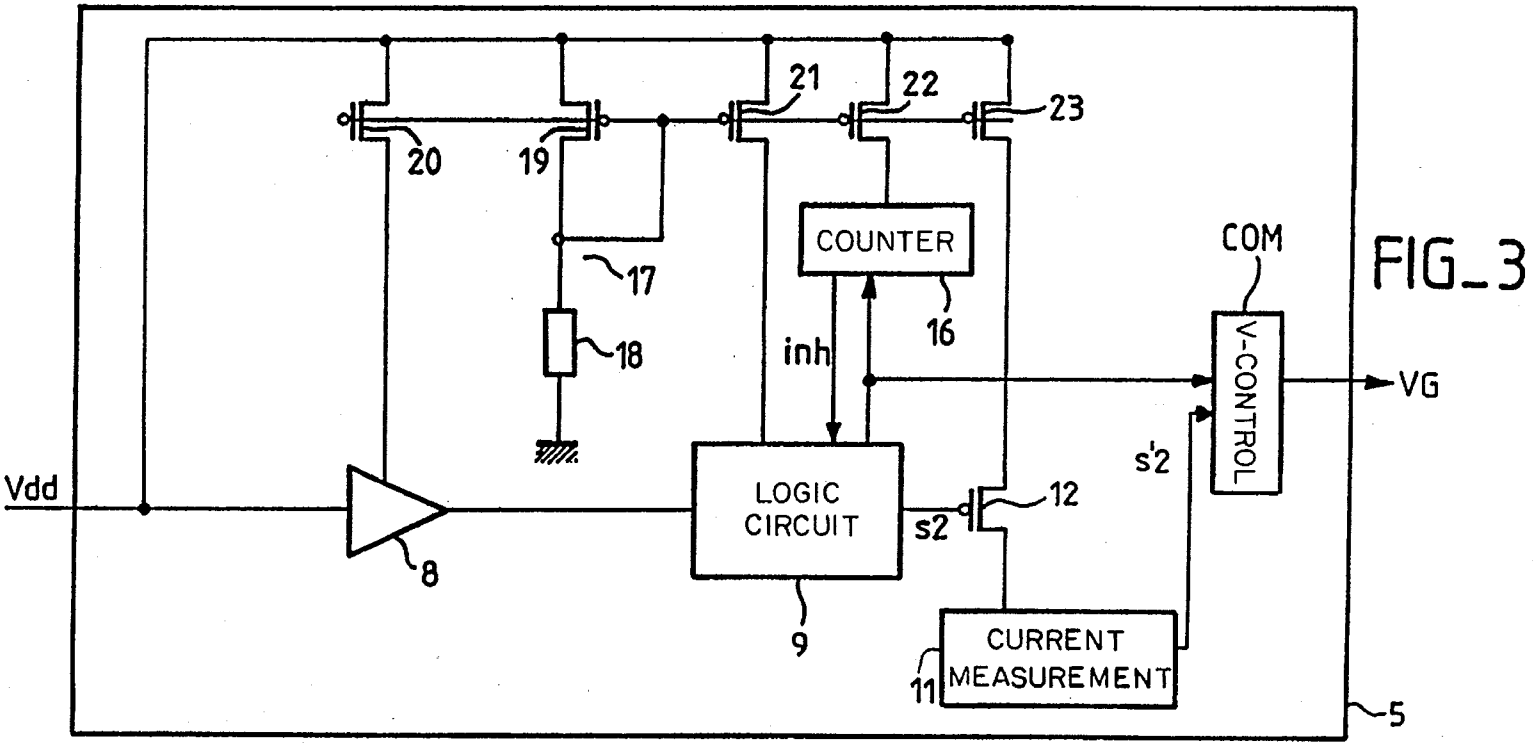
FIG. 3 is a diagram of a gate-control circuit with a current generation circuit according to the invention.

In an improvement shown in FIG. 3, the gate-control circuit 5 has a current generator, working with a current mirror structure. In this way, a current is imposed in each current arm of the gate-control circuit. There is no longer any need to measure the current at the end of manufacture to set the reference values (reference voltages, capacitance). In dynamic operation, the current is imposed and the preheating time is measured in a very reliable manner.

The current generator, in the presently preferred embodiment, comprises a reference arm 17 with a reference load element 18 (resistor), and a transistor 19 mounted as a diode with its drain connected to its gate, and transistors of the same type (20 to 23) all having their gates controlled by the gate of the transistor 19 of the reference arm. The respective current in each transistor is identical to the one imposed in the reference arm, except for the geometrical ratio of the transistors.

In the example, a reference current is thus imposed on the preheating current measurement circuit. This may also be very useful for a particularly reliable measurement of the preheating current.

Finally, to prevent the starter from continuing to work once the lamp is lit, a zener diode D2 (FIG. 2) is preferably provided between the high voltage and the auxiliary supply circuit AUX with a high zener threshold so as to convey a zero voltage to the terminals of the auxiliary supply circuit when the lamp is lit up. In one example, for a lamp that is supplied at 220 volts and has 100 volts at its terminals when it is lit up, it is enough to use a zener threshold of 120 volts.

Other cut-off devices are possible. It is thus possible to provide for a circuit for reading the voltage at the terminals of the power switch to inhibit the logic circuit 9.

Finally, the counter itself makes it possible, as we have seen, to stop the starter.

In one example (FIG. 2), the switch 10 of the voltages V1, V2 on the voltage reference node v of the comparator 8 comprises an N type MOS transistor 24 connected between the voltage reference V2 and the reference node v. This transistor is turned on at its gate by the signal s3 delivered by the logic circuit 9, upon the detection by the comparator 8 of an input voltage greater than or equal to V1. The voltage reference V1 is directly connected to the reference node v. Thus, when the transistor 24 is off, it is the voltage V1 that is applied. When the transistor 24 is on, the voltage V2 lower than V1 is set on the node v.

The logic of the circuit 9 is simple. It depends on the technologies chosen for the different elements that it controls. In the example described more particularly with reference to FIG. 2, the circuit having a power switch 3 constituted by an N type MOSFET transistor, this example also having a gate circuit 12 with a P type MOS transistor and a voltage switch 10 with a N type MOS transistor 24, the signals s1, s2 and s3 are a copy of the output signal sv of the comparator 8. The logic signal 9 preferably has an inhibition transistor 25 to transmit the signal sv to the outputs s1, s2 and s3 of the logic circuit. This inhibition transistor is controlled at its gate by the inhibition signal inh of the counter 16 or by a lighting-up detection circuit that is not shown.

When the comparator 8 detects an input voltage Vdd greater than or equal to V1, its output sv goes to 1. If the inhibition transistor 25 is on (for a permitted lighting-up attempt), the signals s1, s2 and s3 follow this transition. The corresponding logic voltage level is passed by the diode 6 to the gate G of the power switch 3. The gate circuit 12 is off, thus turning off the current measuring circuit 11. The transistor 24 comes on. This imposes the lower reference voltage V2 on the node v of the comparator 8. When the comparator detects an input voltage lower than or equal to V2, its output sv goes to zero. The gate circuit 12 is turned on, turning on the current measurement circuit 11 again, and the transistor 24 goes off. This again imposes the reference voltage V1 on the voltage reference node of the comparator 8.

The voltage references will be provided, for example, by internal bandgap circuits. Maximum and minimum voltages depend on the IC technology used. V1 is the maximum operating voltage of the device, V2 is above the minimum operating voltage, e.g. 1V above.

The entire gate-control circuit 5 can be easily made in the form of an integrated electronic circuit. This is a definite advantage.

In one improvement, it will be provided that if the control circuit comprises a current generator working with a current mirror structure as shown in FIG. 3, the reference resistor 18 will be attached to the exterior of this integrated circuit. This makes it possible, if necessary, to adjust this value very easily depending on the desired period of preheating and above all makes it possible to use high-precision resistors. This cannot be done by integrated circuit technology.

The electronic starter according to the invention, by using its consumption current during the preheating period to carry out a precise measurement of voltage based on its own consumption characteristics (in particular the discharging of the capacitor), enables a particularly simple and reliable control of the power switch.

Furthermore, it enables reduced and controlled consumption and far lower capacitance than that needed in the prior art circuits.

In one example, the capacitance of the holding capacitor is about one microfarad. It is no longer necessary to use electrochemical capacitors. This makes it possible to prolong the lifetime of these starters.

According to a disclosed class of innovative embodiments, there is provided: A starting circuit for use with a fluorescent lamp which is connected through an inductor to AC power, comprising: a power supply capacitor, operatively connected to be charged through an isolation diode by rectified DC outputs taken from terminals of the lamp, and to provide a logic supply voltage output; a hysteretic comparator powered from said logic supply voltage output, and operatively connected to turn on an electronically controlled solid-state switch which is operatively connected to short first and second lamp terminals together, only while said logic supply voltage output is within a defined range of voltages.

According to another disclosed class of innovative embodiments, there is provided: A starting circuit for use with a fluorescent lamp which is connected through an inductor to AC power, comprising: a diode ring connected to receive AC inputs from two terminals at opposite ends of the lamp, and to provide rectified DC outputs; an electronically controlled solid-state switch connected to short said rectified DC outputs together under control of signals received on a control terminal of said switch; a power supply capacitor, operatively connected to be charged through an isolation diode by said rectified DC outputs, and to provide a logic supply voltage output; a hysteretic comparator powered from said logic supply voltage output, and operatively connected to attempt to turn on said switch only while said logic supply voltage output is within a defined range of voltages; and a counter connected to count the number of times said comparator attempts to turn on said switch, and to disable said comparator if a predetermined maximum number is exceeded.

According to another disclosed class of innovative embodiments, there is provided: A starting circuit for use with a fluorescent lamp which is connected through an inductor to AC power, comprising: a diode ring connected to receive AC inputs from two terminals at opposite ends of the lamp, and to provide rectified DC outputs; a solid-state switch connected to controllably short said rectified DC outputs together in dependence on the voltage of a control terminal of said switch; a power supply capacitor, operatively connected through an isolation diode and a reverse-breakdown diode to be charged by said rectified DC outputs, and to provide a logic supply voltage output; a hysteretic comparator powered from said logic supply voltage output, and operatively connected to provide an activation signal at an output thereof only while said logic supply voltage output is within a defined range of voltages; and a counter connected to count the number of times said comparator attempts to turn on said switch, and to drive a disable output active if a predetermined maximum number is exceeded;

and intercept logic interposed at said output of said comparator, and connected to cut off said activation signal whenever said disable signal goes active.

According to another disclosed class of innovative embodiments, there is provided: A starting circuit for use with a fluorescent lamp which is connected through an inductor to AC power, comprising: a power supply capacitor, operatively connected to be charged by rectified DC outputs taken from terminals of the lamp, and to provide a logic supply voltage output; a hysteretic comparator powered from said logic supply voltage output, and operatively connected to turn on an electronically controlled solid-state switch which is operatively connected to short first and second lamp terminals together, only while said logic supply voltage output is within a defined range of voltages; and current-measuring circuitry which is operatively connected to monitor current passed by said switch, and to control turn-off of said switch in dependence on the level of current passed by said switch, regardless of the output of said comparator.

According to another disclosed class of innovative embodiments, there is provided: An electronic starter of a fluorescent lamp comprising a power switch parallel-connected with the lamp and supplied at high voltage, a gate-control circuit of said switch comprising a circuit for the measurement of a determined preheating time and an auxiliary supply circuit parallel-connected with said switch and comprising a capacitor to give a logic supply voltage to the gate-control circuit on a terminal of said capacitor, wherein the preheating time measurement circuit comprises a comparator with two voltage references, a first voltage reference greater than a second voltage reference, the comparator having one input connected to the terminal of the capacitor and one output connected to a logic circuit to switch the first voltage reference over to the comparator when the high voltage is turned on, and so that: upon the detection of an input voltage corresponding to the first voltage reference, it will deliver a start-of-preheating detection signal to activate the closing of the power switch and switch the second voltage reference over to the comparator, and upon the detection of an input voltage corresponding to the second voltage reference, it will deliver an end-of-preheating detection signal to activate the opening of the power switch.

Modifications and Variations

As will be recognized by those skilled in the art, the innovative concepts described in the present application can be modified and varied over a tremendous range of applications, and accordingly the scope of patented subject matter is not limited by any of the specific exemplary teachings given. For example, as will be obvious to those of ordinary skill in the art, other circuit elements can be added to, or substituted into, the specific circuit topologies shown.

For example, diode ring 4 and power transistor 3 would preferably be integrated with the control circuit 5, but could alternatively be discrete. Thus discrete elements would normally include capacitor C2, diode D2, diode D1, and R, but could include others.

For another example, temperature dependence in the delay period can be introduced, if desired (e.g. to provide a longer preheating time at very low temperatures), by generating the reference voltages in such a way that their difference V1-V2 shows some temperature dependence.

What is claimed is:

1. A starting circuit for use with a fluorescent lamp which is connected through an inductor to AC power, comprising:

a power supply capacitor, operatively connected to be charged through an isolation diode by rectified DC outputs taken from terminals of the lamp, and to provide a logic supply voltage output;

a hysteretic comparator powered from said logic supply voltage output, and operatively connected to turn on an electronically controlled solid-state switch which is operatively connected to short first and second lamp terminals together, only while said logic supply voltage output is within a defined range of voltages.

2. The circuit of claim 1, further comprising current source circuitry which is connected to precisely define the current drawn from said logic supply voltage output.

3. The circuit of claim 1, wherein said hysteretic comparator comprises: a comparator powered from said logic supply voltage output, and operatively connected to compare said logic supply voltage output with a reference voltage, and to attempt to turn on said switch when said logic supply voltage output exceeds said reference voltage; and a switch which is operatively connected to alter said reference voltage when said comparator attempts to turn on said switch.

4. A starting circuit for use with a fluorescent lamp which is connected through an inductor to AC power, comprising:

a diode ring connected to receive AC inputs from two terminals at opposite ends of the lamp, and to provide rectified DC outputs;

an electronically controlled solid-state switch connected to short said rectified DC outputs together under control of signals received on a control terminal of said switch;

a power supply capacitor, operatively connected to be charged through an isolation diode by said rectified DC outputs, and to provide a logic supply voltage output;

a hysteretic comparator powered from said logic supply voltage output, and operatively connected to attempt to turn on said switch only while said logic supply voltage output is within a defined range of voltages; and a counter connected to count the number of times said comparator attempts to turn on said switch, and to disable said comparator if a predetermined maximum number is exceeded.

5. The circuit of claim 4, further comprising current source circuitry which is connected to precisely define the current drawn from said logic supply voltage output.

6. The circuit of claim 4, wherein said hysteretic comparator comprises: a comparator powered from said logic supply voltage output, and operatively connected to compare said logic supply voltage output with a reference voltage, and to attempt to turn on said switch when said logic supply voltage output exceeds said reference voltage; and a switch which is operatively connected to alter said reference voltage when said comparator attempts to turn on said switch.

7. A starting circuit for use with a fluorescent lamp which is connected through an inductor to AC power, comprising:

a diode ring connected to receive AC inputs from two terminals at opposite ends of the lamp, and to provide rectified DC outputs;

a solid-state switch connected to controllably short said rectified DC outputs together in dependence on the voltage of a control terminal of said switch;

a power supply capacitor, operatively connected through an isolation diode and a reverse-breakdown diode to be charged by said rectified DC outputs, and to provide a logic supply voltage output;

a hysteretic comparator powered from said logic supply voltage output, and operatively connected to provide an activation signal at an output thereof only while said logic supply voltage output is within a defined range of voltages; and a counter connected to count the number of times said comparator attempts to turn on said switch, and to drive a disable output active if a predetermined maximum number is exceeded; and intercept logic interposed at said output of said comparator, and connected to cut off said activation signal whenever said disable signal goes active.

8. The circuit of claim 7, further comprising current source circuitry which is connected to precisely define the current drawn from said logic supply voltage output.

9. The circuit of claim 7, wherein said hysteretic comparator comprises: a comparator powered from said logic supply voltage output, and operatively connected to compare said logic supply voltage output with a reference voltage, and to attempt to turn on said switch when said logic supply voltage output exceeds said reference voltage; and a switch which is operatively connected to alter said reference voltage when said comparator attempts to turn on said switch.

10. A starting circuit for use with a fluorescent lamp which is connected through an inductor to AC power, comprising:

a power supply capacitor, operatively connected to be charged by rectified DC outputs taken from terminals of the lamp, and to provide a logic supply voltage output;

a hysteretic comparator powered from said logic supply voltage output, and operatively connected to turn on an electronically controlled solid-state switch which is operatively connected to short first and second lamp terminals together, only while said logic supply voltage output is within a defined range of voltages; and current-measuring circuitry which is operatively connected to monitor current passed by said switch, and to control turn-off of said switch in dependence on the level of current passed by said switch, regardless of the output of said comparator.

11. The circuit of claim 10, further comprising an isolation diode which is connected so that said capacitor is charged through said isolation diode.

12. The circuit of claim 10, further comprising current source circuitry which is connected to precisely define the current drawn from said logic supply voltage output.

13. The circuit of claim 10, wherein said hysteretic comparator comprises: a comparator powered from said logic supply voltage output, and operatively connected to compare said logic supply voltage output with a reference voltage, and to attempt to turn on said switch when said logic supply voltage output exceeds said reference voltage; and a switch which is operatively connected to alter said reference voltage when said comparator attempts to turn on said switch.

14. An electronic starter of a fluorescent lamp comprising a power switch parallel-connected with the lamp and supplied at high voltage, a gate-control circuit of said switch comprising a circuit for the measurement of a determined preheating time and an auxiliary supply circuit parallel-connected with said switch and comprising a capacitor to give a logic supply voltage to the gate-control circuit on a terminal of said capacitor, wherein the preheating time measurement circuit comprises a comparator with two voltage references, a first voltage reference greater than a second voltage reference, the comparator having one input connected to the terminal of the capacitor and one output connected to a logic circuit to switch the first voltage reference over to the comparator when the high voltage is turned on, and so that:

upon the detection of an input voltage corresponding to the first voltage reference, it will deliver a start-of-preheating detection signal to activate the closing of the power switch and switch the second voltage reference over to the comparator, and upon the detection of an input voltage corresponding to the second voltage reference, it will deliver an end-of-preheating detection signal to activate the opening of the power switch.

15. An electronic starter according to claim 14, wherein the gate-control circuit is an integrated circuit.

16. An electronic starter according to claim 14, wherein the logic circuit again switches the first voltage reference over to the comparator upon the detection of an input voltage corresponding to the second reference, for a new preheating step.

17. An electronic starter according to claim 14, wherein the gate-control circuit comprises a circuit for the generation of a determined current, with a current mirror structure, with a current reference arm comprising a reference resistor.

18. An electronic starter according to claim 17, wherein the gate-control-circuit is made in one and the same integrated circuit, except for the reference resistor which is placed externally.

19. An electronic starter according to claim 14, wherein the gate-control circuit comprises a diode, the cathode of which is connected to the gate of the power switch and the anode of which receives the start-of-preheating detection signal to switch a positive logic voltage over to the gate of the power switch, to activate its closure.

20. An electronic starter according to claim 19, wherein the gate-control circuit comprises a first transistor connected between the gate of the power switch and the ground and receiving, at its gate, the end-of-preheating detection signal delivered by the logic circuit or the signal that activates the opening, delivered by the current measurement circuit, to apply a zero voltage to the gate of the power switch to activate its opening.

21. An electronic starter according to claim 19, wherein the gate-control circuit is an integrated circuit.

22. An electronic starter according to claim 19, wherein the gate-control circuit comprises a circuit for the generation of a determined current, with a current mirror structure, with a current reference arm comprising a reference resistor.

23. An electronic starter according to claim 19, wherein the logic circuit again switches the first voltage reference over to the comparator upon the detection of an input voltage corresponding to the second reference, for a new preheating step.

24. An electronic starter according to claim 14, wherein the gate-control circuit furthermore comprises a preheating current measurement circuit to deliver a signal to activate the opening of the switch after reception of the end-of-preheating detection signal, upon the detection of an optimum preheating current in the lamp.

25. An electronic starter according to claim 24, wherein the gate-control circuit comprises a gate circuit that is placed between the logic supply voltage and the current measurement circuit and is controlled by the logic circuit to turn the current measurement circuit off upon detection of the first voltage reference and turn it on upon detection of the second voltage reference.

26. An electronic starter according to claim 24, wherein the gate-control circuit comprises a diode, the cathode of which is connected to the gate of the power switch and the anode of which receives the start-of-preheating detection signal to switch a positive logic voltage over to the gate of the power switch, to activate its closure.

27. An electronic starter according to claim 24, wherein the circuit for measuring the preheating current of the lamp comprises an amplifier of a shunted current and a comparator for comparison with a current reference value.

28. An electronic starter according to claim 27, wherein the comparator for comparison with a reference value is a window type comparator so that it switches over for a passage through the reference value with a negative slope.

29. An electronic starter according to claim 27, wherein the gate-control circuit comprises a circuit for the generation of a determined current, with a current mirror structure, with a current reference arm comprising a reference resistor.

30. An electronic starter according to claim 24, wherein the preheating current measurement circuit comprises an amplifier of a shunted current and a comparator for making comparison with a power reference value.

31. An electronic starter according to claim 30, wherein the comparator for comparison with a reference value is a window type comparator so that it switches over for a passage through the reference value with a negative slope.

32. An electronic starter according to claim 24, wherein the gate-control circuit comprises a circuit for the generation of a determined current, with a current mirror structure, with a current reference arm comprising a reference resistor.

33. An electronic starter according to claim 30, wherein the gate-control circuit comprises a circuit for the generation of a determined current, with a current mirror structure, with a current reference arm comprising a reference resistor.

34. An electronic starter according to claim 24, wherein the logic circuit again switches the first voltage reference over to the comparator upon the detection of an input voltage corresponding to the second reference, for a new preheating step.

35. An electronic starter according to claim 27, wherein the logic circuit again switches the first voltage reference over to the comparator upon the detection of an input voltage corresponding to the second reference, for a new preheating step.

36. An electronic starter according to claim 30, wherein the logic circuit again switches the first voltage reference over to the comparator upon the detection of an input voltage corresponding to the second reference, for a new preheating step.

37. An electronic starter according to claim 16, wherein the gate-control circuit furthermore comprises a counter that receives a counting/countdown command for each new preheating step to deactivate the gate-control circuit at the end of a determined number of preheating commands.

38. An electronic starter according to claim 14, wherein the zener diode is placed between the high voltage and the auxiliary supply circuit, to turn the starter off when the lamp is lit up.

39. An electronic starter according to claim 19, wherein the zener diode is placed between the high voltage and the auxiliary supply circuit, to turn the starter off when the lamp is lit up.

40. An electronic starter according to claim 24, wherein the zener diode is placed between the high voltage and the auxiliary supply circuit, to turn the starter off when the lamp is lit up.

41. An electronic starter according to claim 27, wherein the zener diode is placed between the high voltage and the auxiliary supply circuit, to turn the starter off when the lamp is lit up.

42. An electronic starter according to claim 30, wherein the zener diode is placed between the high voltage and the auxiliary supply circuit, to turn the starter off when the lamp is lit up.

43. An electronic starter according to claim 24, wherein the gate-control circuit is an integrated circuit.

44. An electronic starter according to claim 27, wherein the gate-control circuit is an integrated circuit.

45. An electronic starter according to claim 30, wherein the gate-control circuit is an integrated circuit.

46. An electronic starter according to claim 37, wherein the gate-control-circuit is made in one and the same integrated circuit, except for the reference resistor which is placed externally.

47. A method for starting a fluorescent lamp, comprising the steps of:

(a.) monitoring the voltage across a switch which operatively connected, through a diode ring, in series with a ballast inductor and filaments of the lamp, to an AC mains connection;

(b.) closing said switch if the voltage thereon exceeds a first predetermined threshold value;

(c.) while said switch is open, rectifying the voltage across said switch to charge a storage capacitor; and, while said switch is closed, drawing power from said storage capacitor to power at least one, but not every, circuit portion of an integrated circuit; and (d.) monitoring the voltage on said capacitor while said switch is closed; and opening said switch when the voltage on said capacitor drops below a second predetermined threshold.

48. The method of claim 47, wherein said monitoring step (d.) is performed by said at least one circuit portion.

49. The method of claim 47, wherein said at least one circuit portion includes only enough elements to perform said monitoring step (d.).

* * * * *